US009226554B2

(12) United States Patent
Kodama et al.

(10) Patent No.: US 9,226,554 B2
(45) Date of Patent: Jan. 5, 2016

(54) CIRCULAR CUT DIAMOND

(71) Applicants: Yoshihiko Kodama, Markham (CA); Leonard J. Strnad, II, Bay Village, OH (US)

(72) Inventors: Yoshihiko Kodama, Markham (CA); Leonard J. Strnad, II, Bay Village, OH (US)

( * ) Notice: Subject to any disclaimer, the term of this patent is extended or adjusted under 35 U.S.C. 154(b) by 0 days.

(21) Appl. No.: 14/274,939

(22) Filed: May 12, 2014

(65) Prior Publication Data

US 2015/0320153 A1 Nov. 12, 2015

(51) Int. Cl.
*A44C 17/00* (2006.01)
*A44C 17/02* (2006.01)

(52) U.S. Cl.
CPC ..... *A44C 17/02* (2013.01); *A44C 17/00* (2013.01); *A44C 17/001* (2013.01)

(58) Field of Classification Search
CPC ..... A44C 17/00; A44C 17/001
See application file for complete search history.

(56) References Cited

U.S. PATENT DOCUMENTS

| | | | |
|---|---|---|---|
| 693,084 | A | 2/1902 | Townsend |
| 712,155 | A | 10/1902 | Seddon |
| 732,119 | A | 6/1903 | Schenck |
| 839,356 | A | 12/1905 | Wood |
| 809,531 | A | 1/1906 | Schenck |
| 2,340,659 | A | 2/1944 | Goldstein |
| 2,364,031 | A | 11/1944 | Suderov |
| 3,286,486 | A | 11/1966 | Huisman et al. |
| 3,394,692 | A | 7/1968 | Sirakian |
| 3,490,250 | A | 1/1970 | Jones |
| 3,528,261 | A | 9/1970 | Jones |
| 3,534,510 | A | 10/1970 | Leibowitz |
| 3,585,764 | A | 6/1971 | Huisman |
| 3,665,729 | A | 5/1972 | Elbe |
| 3,763,665 | A | 10/1973 | Polakiewicz |
| 3,788,097 | A | 1/1974 | Elbe |
| 3,796,065 | A | 3/1974 | Watermeyer |
| 3,835,665 | A | 9/1974 | Kitchel |
| 4,020,649 | A | 5/1977 | Grossbard |
| 4,083,352 | A | 4/1978 | Andrychuk |
| 4,118,949 | A | 10/1978 | Grossbard |
| 4,306,427 | A | 12/1981 | Urban |
| 4,738,240 | A | 4/1988 | Aich |
| 5,090,216 | A | 2/1992 | Waugh |
| 5,454,235 | A | 10/1995 | Freiesleben |
| 5,612,102 | A | 3/1997 | Nakama |
| 5,657,647 | A | 8/1997 | Freiesleben |
| 5,970,744 | A | 10/1999 | Greeff |
| 6,397,832 | B1 | 6/2002 | Shuto |
| 6,405,562 | B1 | 6/2002 | Zimet et al. |
| 6,422,039 | B2 | 7/2002 | Bamminger et al. |
| 6,430,963 | B1 | 8/2002 | Friedman et al. |
| 6,449,985 | B1 | 9/2002 | Kejejian |
| 6,604,382 | B2 | 8/2003 | Shuto |
| 6,694,778 | B2 | 2/2004 | Kawabuchi et al. |
| 6,698,239 | B2 | 3/2004 | Wueste |
| 6,990,833 | B2 | 1/2006 | Smith |
| 7,249,471 | B2 * | 7/2007 | Kawabuchi et al. ..... 63/33 |

(Continued)

*Primary Examiner* — Emily Morgan

(57) ABSTRACT

A circular cut diamond (10) comprising a girdle (20), a crown (30), and a pavilion (40). The crown (30) comprises a circumferential succession of eight main crown facets which extend upward from an upper edge (23) of the girdle at a crown angle which is greater than 19° and less than 25°. The pavilion (40) comprises a circumferential succession of eight main pavilion facets which extend downward from a lower edge (24) of the girdle at a pavilion angle which is greater than 41° and less than 43°. The circular cut diamond (10) can compete with the brilliance of an ideal cut diamond without a significant compromise in carat weight.

20 Claims, 9 Drawing Sheets

(56) References Cited

U.S. PATENT DOCUMENTS

Figure 1:
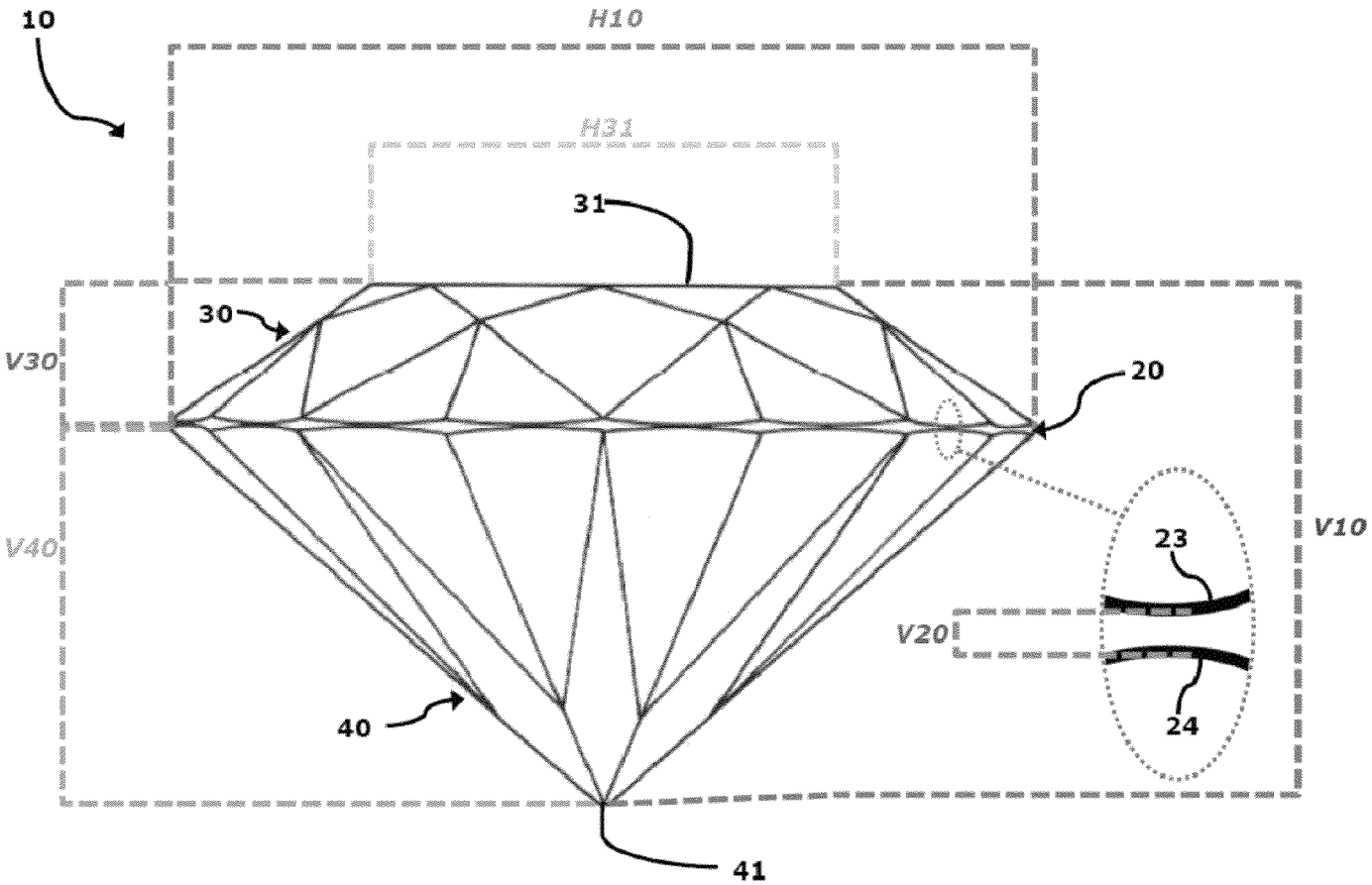
Figure 2A:
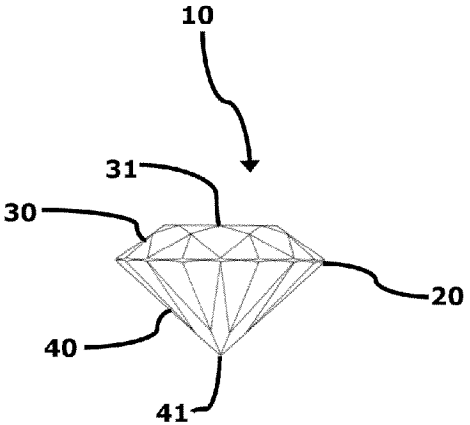
Figure 2B:
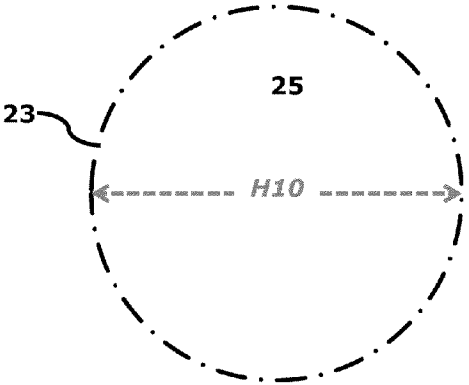
Figure 2C:
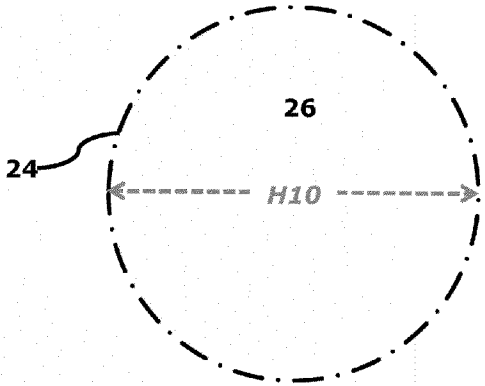
Figure 2D:
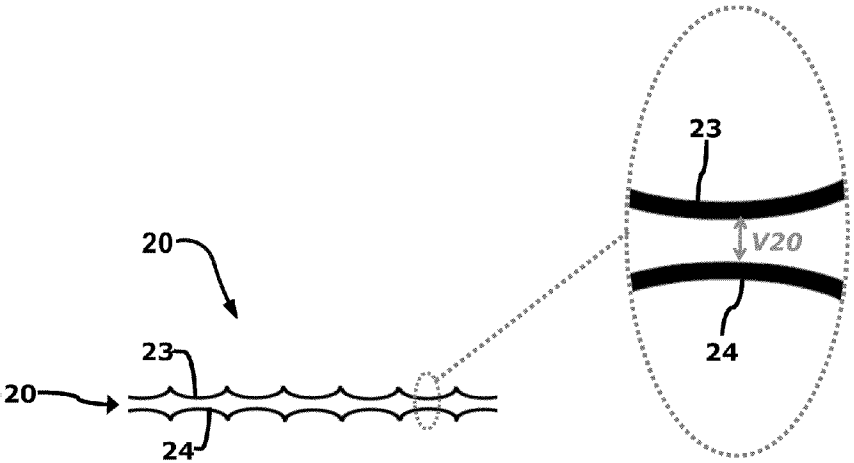
Figure 3B:
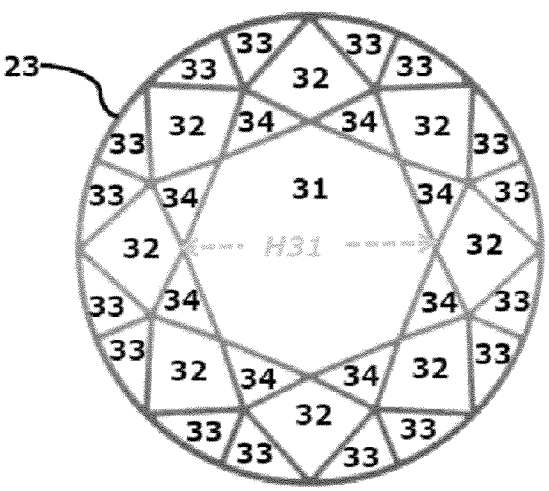
Figure 3C:
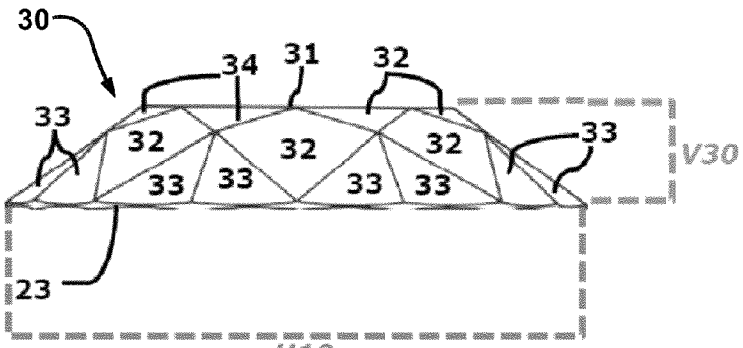
Figure 3A:
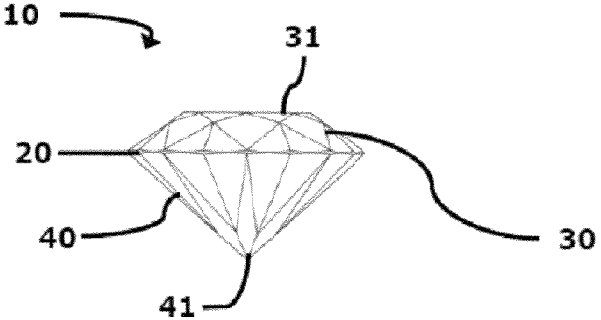
Figure 3D:
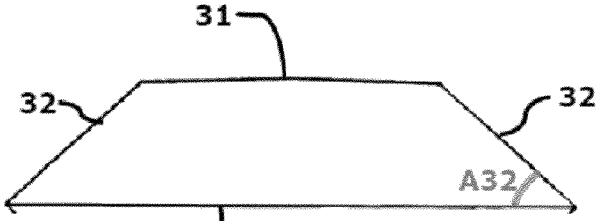
Figure 3E:
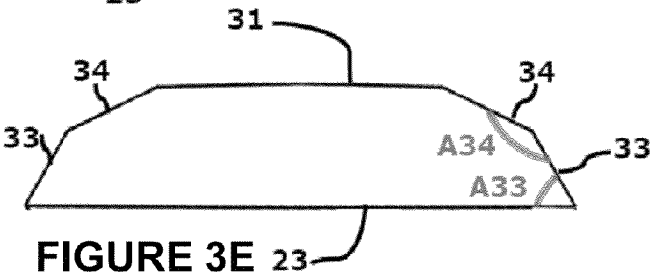
Figure 4A:
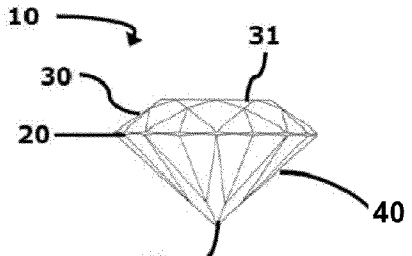
Figure 4B:
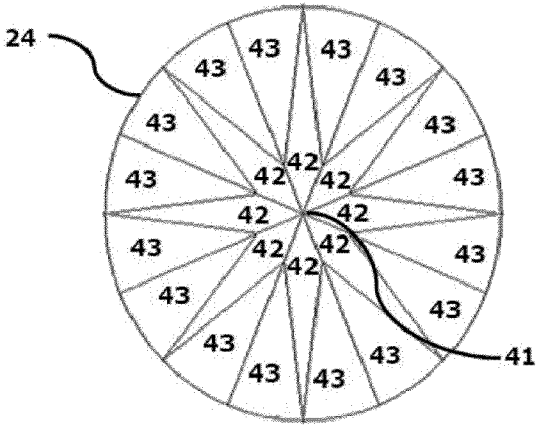
Figure 4C:
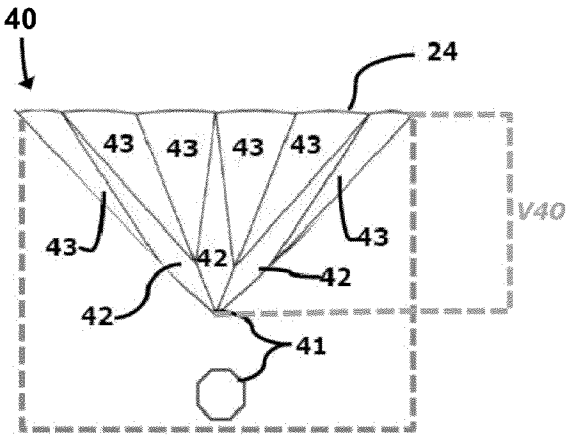
Figure 4D:
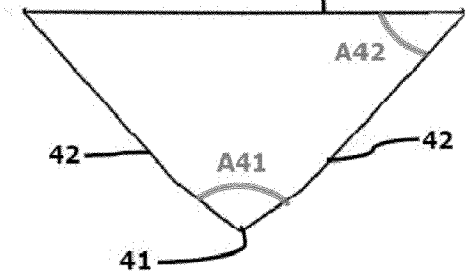
Figure 4E:
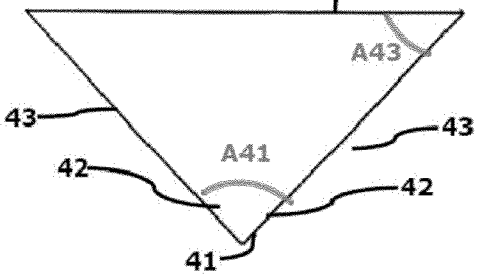
Figure 5C:
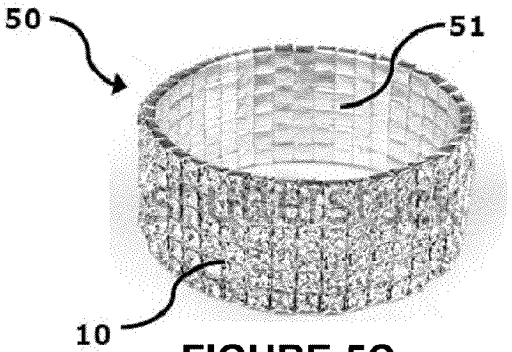
Figure 5D:
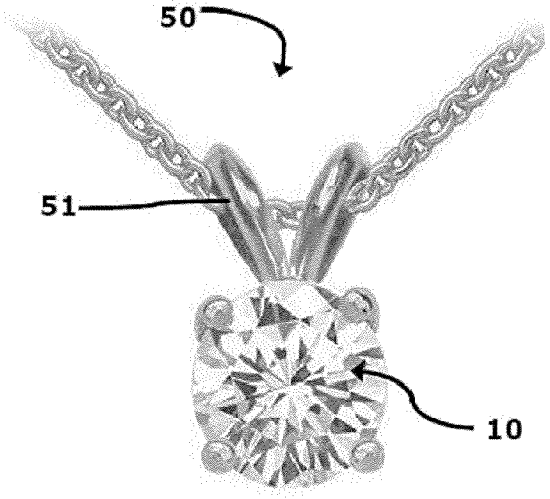
Figure 5A:
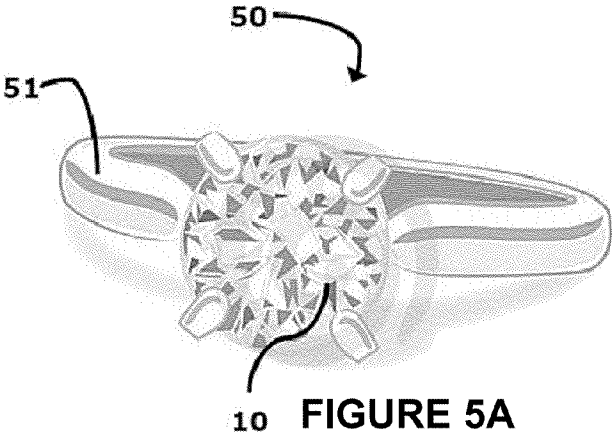
Figure 5B:
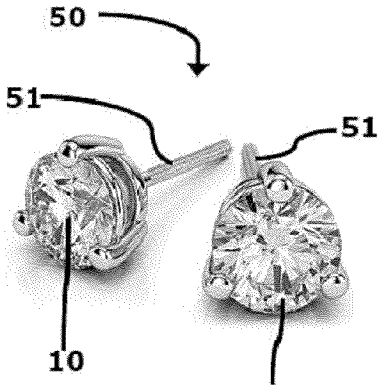

| | | | | |
|---|---|---|---|---|
| 7,251,619 | B2 | 7/2007 | Holloway | |
| 2002/0043078 | A1 | 4/2002 | Kawabuchi et al. | |
| 2004/0050097 | A1 | 3/2004 | Eisenberg | |
| 2004/0055333 | A1* | 3/2004 | Smith | 63/32 |
| 2005/0115275 | A1 | 6/2005 | Kedem et al. | |
| 2007/0186586 | A1 | 8/2007 | Matsumura et al. | |
| 2010/0282234 | A1* | 11/2010 | Matsumura et al. | 125/30.01 |
| 2011/0000259 | A1* | 1/2011 | Strnad et al. | 63/32 |
| 2011/0146350 | A1* | 6/2011 | Vets | 63/32 |
| 2011/0239705 | A1* | 10/2011 | Matsumura et al. | 63/32 |
| 2012/0180525 | A1* | 7/2012 | Weingarten | 63/32 |

* cited by examiner

| | | Diamond 60A | Diamond 10 | IDEAL CUT |
|---|---|---|---|---|
| H10 /V10 | diamond depth | 58.4% | 56% to 61% | 59.3% plus girdle thickness |
| H31 /H10 | table size | 51.3% | 48% to 52% | 53% to 57% |
| V20 /H10 | gridle thickness | 3.5% | 0.5% to 7% | 0.7% to 1.7% |
| V30 /H10 | crown height | 11.2% | 10% to 12% | 16.20% |
| A32 | crown angle | 24.21° | 19°> < 25° | 34.5° |
| V40 /H10 | pavilion depth | 43.5% | 40% to 45% | 43.10% |
| A42 | pavilion angle | 41.03° | 41°> < 43° | 40.75° |
| A41 | tip angle | 98° | 94° to 98° | 98.5° |
| H10 | diameter | 5.7 mm | | |
| | weight | 0.65 carats | | |
| | tip size | none to small | | |
FIGURE 6A
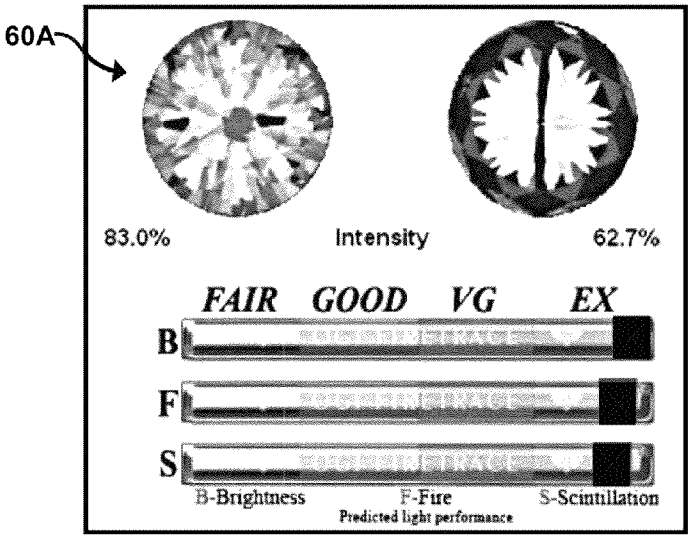
FIGURE 6B
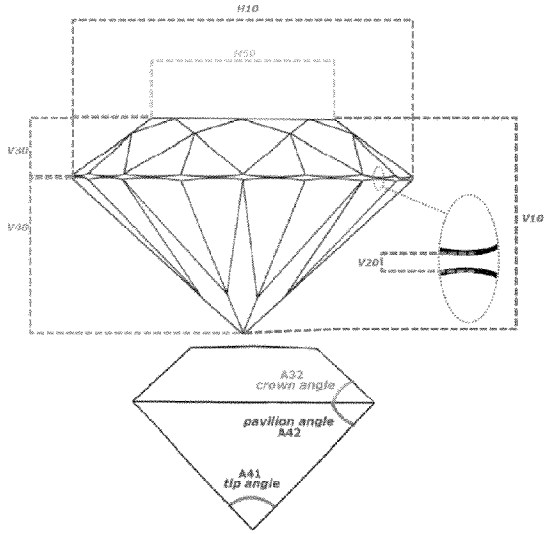
FIGURE 6C

| | | Diamond 60B | Diamond 10 | IDEAL CUT |
|---|---|---|---|---|
| H10 /V10 | diamond depth | 59.3% | 56% to 61% | 59.3% plus girdle thickness |
| H31 /H10 | table size | 51.2% | 48% to 52% | 53% to 57% |
| V20 /H10 | gridle thickness | 5.0% | 0.5% to 7% | 0.7% to 1.7% |
| V30 /H10 | crown height | 10.5% | 10% to 12% | 16.20% |
| A32 | crown angle | 22.94° | 19°> < 25° | 34.5° |
| V40 /H10 | pavilion depth | 44.0% | 40% to 45% | 43.10% |
| A42 | pavilion angle | 41.38 | 41°> < 43° | 40.75° |
| A41 | tip angle | 97.24° | 94° to 98° | 98.5° |
| H10 | diameter | 7.33 mm | | |
| | weight | 1.39 carats | | |
| | tip size | none to small | | |
FIGURE 7A
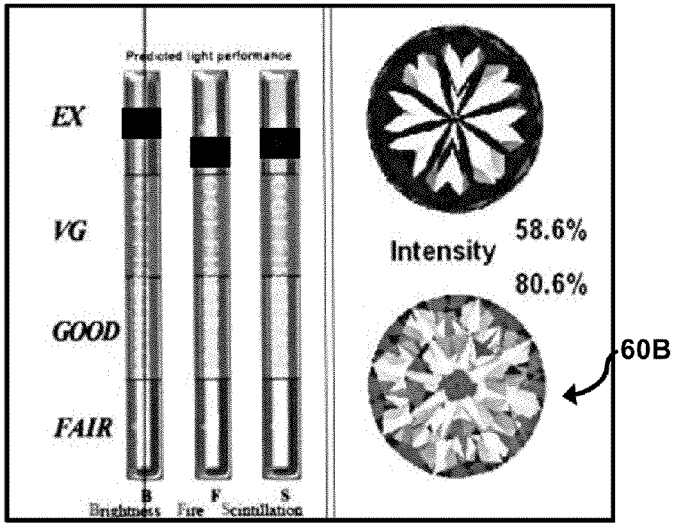
FIGURE 7B
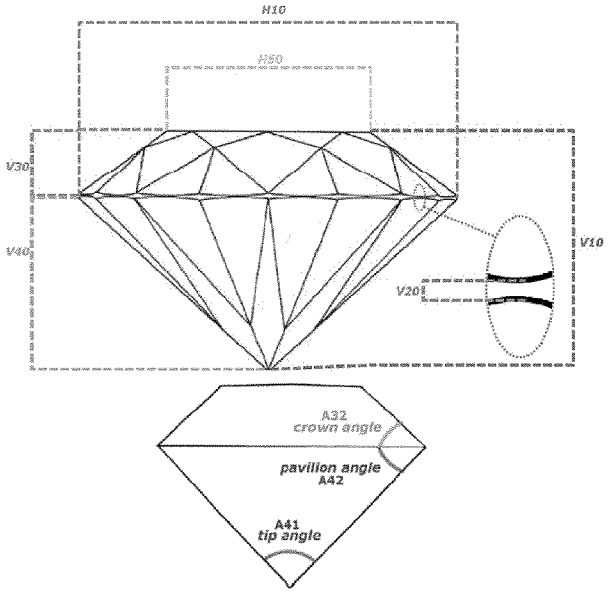
FIGURE 7C

| | | Diamond 60C | Diamond 10 | IDEAL CUT |
|---|---|---|---|---|
| H10 /V10 | diamond depth | 60.2% | 56% to 61% | 59.3% plus girdle thickness |
| H31 /H10 | table size | 52.0% | 48% to 52% | 53% to 57% |
| V20 /H10 | gridle thickness | 4.1% | 0.5% to 7% | 0.7% to 1.7% |
| V30 /H10 | crown height | 10.7% | 10% to 12% | 16.20% |
| A32 | crown angle | 23.63 | 19°> < 25° | 34.5° |
| V40 /H10 | pavilion depth | 45.4% | 40% to 45% | 43.10% |
| A42 | pavilion angle | 42.14 | 41°> < 43° | 40.75° |
| A41 | tip angle | 95.72° | 94° to 98° | 98.5° |
| H10 | diameter | 7.35 mm | | |
| | weight | 1.40 carats | | |
| | tip size | none to small | | |
FIGURE 8A
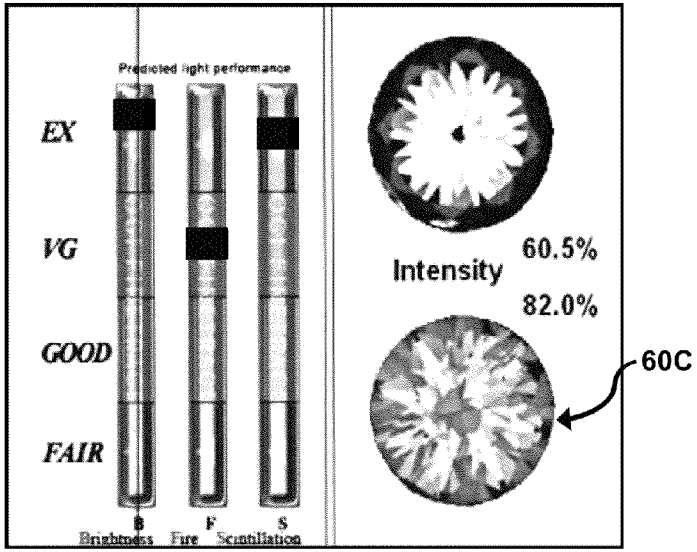
FIGURE 8B
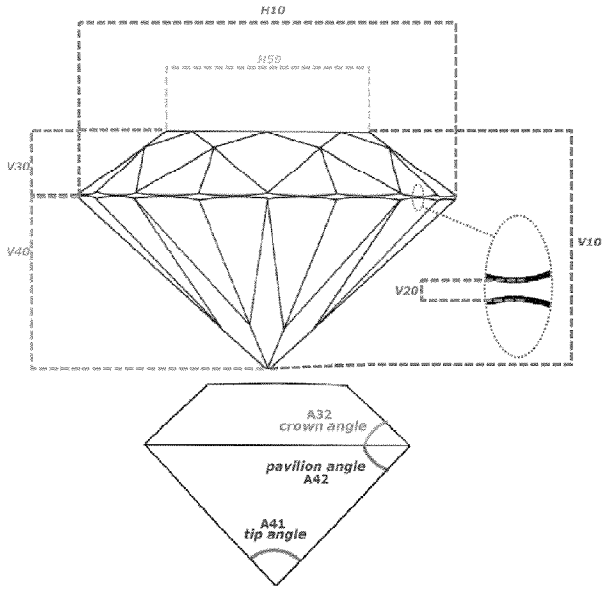
FIGURE 8C

| | | Diamond 60D | Diamond 10 | IDEAL CUT |
|---|---|---|---|---|
| H10 /V10 | diamond depth | 60.9% | 56% to 61% | 59.3% plus girdle thickness |
| H31 /H10 | table size | 49.8% | 48% to 52% | 53% to 57% |
| V20 /H10 | gridle thickness | 4.2% | 0.5% to 7% | 0.7% to 1.7% |
| V30 /H10 | crown height | 10.5% | 10% to 12% | 16.20% |
| A32 | crown angle | 22.31 | 19°> < 25° | 34.5° |
| V40 /H10 | pavilion depth | 46.1% | 40% to 45% | 43.10% |
| A42 | pavilion angle | 42.76 | 41°> < 43° | 40.75° |
| A41 | tip angle | 94.48 | 94° to 98° | 98.5° |
| H10 | diameter | 6.99mm | | |
| | weight | 1.21 carats | | |
| | tip size | none to small | | |
FIGURE 9A
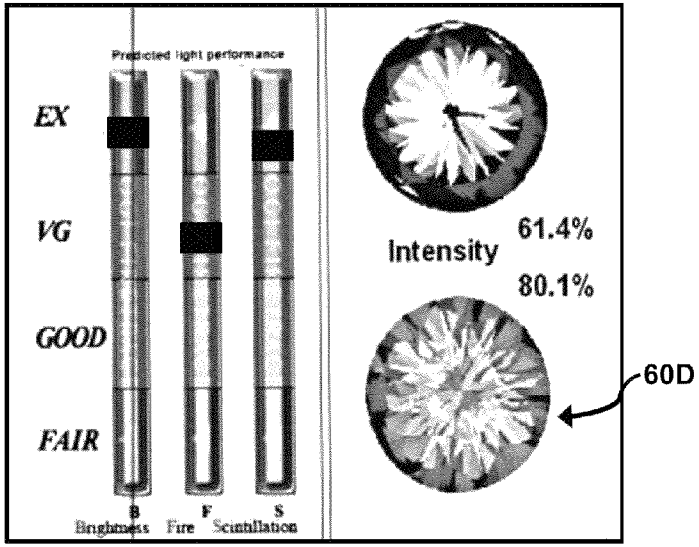
FIGURE 9B
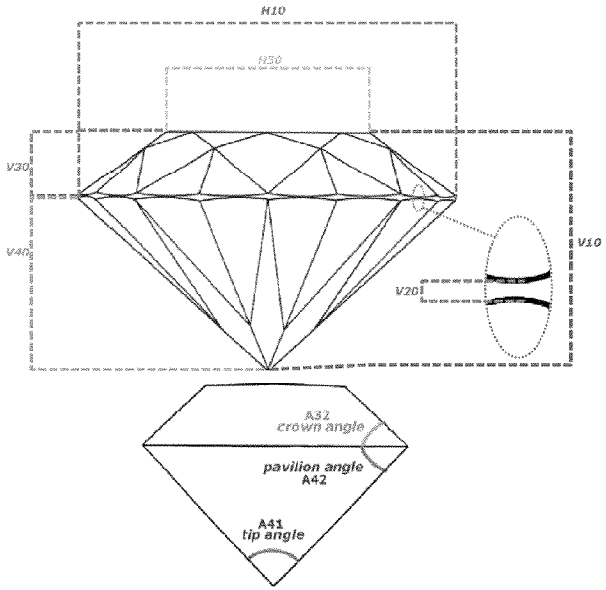
FIGURE 9C

CIRCULAR CUT DIAMOND

RELATED APPLICATIONS

This application is related to U.S. patent application Ser. No. 12/449,079 which was the national stage entry of International Patent Application No. PCT/US2008/000797. The entire disclosures of these earlier applications are hereby incorporated by reference. To the extent that any inconsistencies exist among the applications, the specification of the present application governs for the purposes of resolving indefiniteness issues.

BACKGROUND

Applicants previously introduced a circular cut diamond having a brilliance which surpassed that of an ideal cut diamond (see specifications incorporated above). In this diamond cut, the crown angle is reduced to be less than that of an ideal cut diamond (i.e., less than 34.5°) while the pavilion angle is maintained at that of an ideal cut diamond (i.e., 40.75°). The reduced crown angle guided light so as to visibly brighten table-surrounding regions of the crown. One side effect, however, of a reduced crown angle is that overall diamond weight decreases. And while jewelry experts universally agree that many parameters factor into the quality of a diamond, the most common diamond purchasers tend to focus almost entirely on carat weight.

SUMMARY

A circular cut diamond is provided which can compete with the brilliance of an ideal cut diamond without a significant compromise in carat weight. In this diamond, the crown angle is less than that of an ideal cut and the pavilion angle is greater than that of an ideal cut. The less-than-ideal-cut crown angle widens the field of rough stones which can be transformed into ideal-cut-competitive diamonds. And the greater-than-ideal-cut pavilion angle compensates for the carat weight loss caused by the decreased crown angle.

DRAWINGS

FIG. 1 shows a circular cut diamond 10 comprising a girdle 20, a crown 30, and pavilion 40.

FIGS. 2A, 2B, 2C, and 2D shows details of the girdle 20.

FIGS. 3A, 3B, 3C, and 3D shows details of the crown 30.

FIGS. 4A, 4B, 4C, 4D, and 4E shows details of the pavilion 40.

FIGS. 5A, 5B, 5C, and 5D shows jewelry pieces 50 incorporating the diamond.

FIGS. 6A-6C. 7A-C, 7A-C, and 9A-C show sample diamonds 60A-60D and the measured intensity, brightness, fire, and scintillation therefor.

DESCRIPTION

The circular cut diamond 10 has proportions adapted to achieve a brilliance which can compete with that of an ideal cut diamond. The cut allows an increase in brilliance which is apparent to non-expert viewers. And the cut allows the diamond to uphold a carat weight akin to that of an analogous ideal cut diamond.

Diamond 10

FIG. 1

The circular cut diamond 10 comprises a girdle 20, a crown 30, and a pavilion 40. In the illustrated and industry-accepted orientation, the crown 30 is situated above the girdle 20 and the pavilion 40 is situated below the girdle 20. A table 31 forms a flat top of the crown 30 and a tip 41 forms a bottom-most aspect of the pavilion 40.

The diamond 10 has a horizontal dimension H10 measured across the girdle 20, and a vertical dimension V10 measured from the table 31 to the tip 41. The table 31 has a horizontal dimension H31 which measured thereacross. The girdle 20 has a vertical dimension V20 measured from its top edge 23 to its bottom edge 24. The crown 30 has a vertical dimension V30 measured from the girdle's top edge 23 to the table 31. The pavilion 40 has a vertical dimension V40 measured from the girdle's bottom edge 24 to the tip 41.

The diamond 10 can have a depth ratio (% H10/V10) of 56% to 61%, a table size (%H31/H10) of 48% to 52%, a girdle thickness (%V20/H10) of 0.5% to 7.0%, a crown height (%V30/H10) of 10% to 12%, and a pavilion depth (%V40/H10) of 40% to 45%.

Girdle 20

FIGS. 2A, 2B, 2C, and 2D

As was indicated above, the girdle 20 has an upper edge 23 and a lower edge 24. When the girdle 20 is viewed from the side, the upper edge 23 has a hills-and-valleys contour, with the valleys meeting margins of facets on the crown 30 (namely upper girdle facets 33, introduced below). The lower edge 24 follows a similar contour, with its inversed valleys being symmetrical to those of the upper edge 23. The valleys of the lower edge meet margins of facets on the pavilion 40 (namely lower girdle facets 43, introduced below). The girdle's vertical dimension V20 is the distance between aligned valleys in the edges 23-24.

When the girdle 20 is viewed from the top (with the crown 30 theoretically removed), the girdle's upper edge 23 follows a circular path in plan defining a circular area 25. When the girdle 20 is viewed from the bottom (with the pavilion 40 theoretically removed), the lower edge 24 follows a similar circular path defining a circular area 26.

The circular area 25 defined by the girdle's upper edge 23 is situated in a horizontal plane and geometrically forms the lower base of the crown 30. The circular area 26 defined by the girdle's lower edge is also situated in a horizontal plane (and thus parallel to the circular area 25) and geometrically forms the upper base of the pavilion 40.

The diamond's horizontal dimension H10 is equal to the diameter of girdle 20, and thus to the diameter of the upper edge 23 or the lower edge 24. As these edges have a circular geometry, diameter measurements should be approximately equal regardless of where taken. To the extent that diameter differences exist, the horizontal dimension H10 would be mean of the maximum and minimum measurements.

As was indicated above, the diamond 10 has a girdle thickness (%V20/H10) of 0.5% to 7.0%. One advantage of applicants' diamond cut is that is able to accommodate thicker girdles than that tolerated by traditional ideal cut diamonds (i.e., 0.7% to 1.7%). Specifically, for example, the diamond 10 can have excellent brightness even with girdle thicknesses in excess of 3%, 4%, and/or 5%. A thicker girdle translates into a greater carat weight, an easier stone-cutting process, and increased chip or break resistance.

Crown 30

FIGS. 3A, 3B, 3C, 3D and 3E

As was indicated above, the crown has a table 31 which forms its flat top surface. The octagonal table 31 is vertically situated parallel to the upper area 25 defined by the girdle's upper edge and horizontally centered relative to the rest of the crown 30. The horizontal dimension H31 is measured from opposing corners of the table 31.

In addition to the table 31 (which is considered a facet), the crown 30 has eight main (or bezel) facets 32 arranged in circumferential succession around the table 31. The facets 32 each have a kite shape with its bridal portion (the smaller triangle) peaking into a table corner and its knot portion (the larger triangle) apexing into a hill on the upper edge 23 of the girdle 30.

The crown 30 also has sixteen upper girdle facets 33 arranged in circumferential succession around the upper edge 23 of the girdle 20. A symmetrical duo of the facets 33 is positioned between the knot segments of each adjacent pair of main facets 32. The facets 33 each have a generally triangular shape with a rounded side, a duo-shared side, and a duo-sovereign side. The rounded sides coincide with valleys on the girdle's upper edge 24. The shared side of each facet 33 concurs with the shared side of the other facet 33 in its duo. The third side merges with the adjacent knot side of the neighboring main facet 32.

The crown 30 further has eight star facets 34 which circumferencially surround the table 31. A star facet 34 is positioned between the bridle portions of each adjacent pair of main facets 32. Each star facet 34 has an isosceles triangle shape with two equal sides and a third unequal side. The equal sides adjoin contiguous bridle sides of the flanking main facets 32. The star facets' third sides each merge with an octagonal margin of the table 31.

The main crown facets 32 each slope upward from the girdle's upper edge 23 (or the circular area 25 defined thereby) at an acute angle A32. The angles A23 should be approximately equal (e.g., within 1.5%) among the main crown facets 32, with their average value being considered the crown angle. The diamond 10 has a crown angle A32 which is greater than 19° and less than 25°.

Each upper girdle facet 33 slopes upward from the girdle's upper edge 23 (or the circular area 25 defined thereby) at an acute angle A33. Each star facet 34 slopes upward from a facet 33 at an obtuse angle A34. The angles A33 are preferably approximately equal (e.g., within 1.5°) and the angles A34 are preferably approximately equal (e.g., within 1.5°). The angles A33 can be greater than the crown angle A32.

As was indicated above, the diamond 10 has a table size (%H31/H10) of 48% to 52% which is less than that required in a conventional ideal cut diamond (i.e., 53% to 57%). As was also indicated above, the diamond 10 has a crown height (%V30/H10) of 10% to 12% which is less than that of a conventional ideal cut diamond (i.e., 16.20%). These comparably less dimension percentages are corollary to the very advantageous reduced crown angle. But the not-as-wide table size and/or the not-as-tall crown height also cause the crown 30 to carry less carat weight.

Pavilion 40

FIGS. 4A, 4B, 4C, 4D and 4E

As was indicated above, the pavilion 40 has a tip 41 which forms its bottommost aspect. The tip 41 can be point which is tangential to a horizontal plane parallel or it can instead be a culet (e.g., having an octagonal shape) which is positioned in a horizontal plane. In either case, the tip 41 is vertically parallel to the circular area 26 defined by the girdle's lower edge 24 and is horizontally centrally located relative thereto.

The pavilion 40 has a circumferential succession of eight main facets 42. The main facets 42 each have a slender kite shape with its bridal portion (the smaller triangle) terminating at the tip 41 and its knot portion (the larger triangle) peaking into a valley on the lower edge 24 of the girdle 20. The adjacent bridal sides of neighboring main facets merge coincide.

The pavilion 40 also has a circumferential succession of sixteen lower girdle facets 43. A twosome of facets 43 is symmetrically positioned between each adjacent pair of main facets 42. Each lower girdle facet 34 has a generally triangular shape with a rounded side merging with valleys on lower girdle edge 24, a shared side which symmetrically joins the twosome, and a sovereign side which coincide with bordering knot sides of flanking main facets 42.

The main pavilion facets 42 slope upward from the tip 41, with opposing facets 42 forming obtuse angles A41. The angles A41 are preferably approximately equal (e.g., within 1.5°) and their average is considered the tip angle. The diamond 10 has a tip angle A41, which can range, for example, from 94° to 98°.

The main pavilion facets 42 slope downward from the girdle's lower edge 24 (or the circular area 26 defined thereby) at an angle A42. The angles A42 are preferably approximately equal (e.g., within 1.5°) and the average thereof is the pavilion angle. The diamond 10 has a pavilion angle A41 which is greater than 41° and less than 43°.

As was indicated above, the diamond 10 has a pavilion depth (%V40/H10) of 40% to 45% which is within the same range as that of a conventional ideal cut diamond (i.e., 43.10%). For a given pavilion depth (V40), the greater-than-ideal-cut pavilion angle A41 causes more stone to be contained in the pavilion 40. This augments the heaviness of the pavilion 40 (and thus the diamond 10) thereby compensating for less weight being carried by the crown 30.

If carat weight is the prevailing parameter in diamond selection, as it often is, a pavilion angle A41 greater than 41.5°, greater than 42° and/or greater than 42.5° may be preferred.

Jewelry 50

FIGS. 5A, 5B, 5C, and 5D

The circular cut diamond 10 can be incorporated into jewelry 50 via mounting hardware 51. The mounting hardware 51 can be adapted to make, for example, a diamond ring, diamond earrings, a diamond bracelet, and/or diamond necklace.

Sample Embodiments 60

FIGS. 6A, 6B, 6C through FIGS. 9A, 9B, and 9C

Example embodiments 60A-60D of the diamond 10 were cut and tested for intensity, brightness, fire, and scintillation. This testing was performed by a Scanox Proportion HD high resolution proportion system which is commercially available from OGI Systems Ltd. This system was designed for use in situations (e.g., labs) requiring maximum accuracy during diamond scanning.

The diamond embodiments 60A-60D each have brightness readings in the "excellent" range, without any significant sacrifice in scintillation and/or fire. Such brilliance will be apparent to a non-expert viewer and will also appease the concern for high carat weight.

The diamond 60A (crown angle 24.21° and pavilion angle 41.03°) has a crown intensity of 83.0%. This diamond 60A has a brightness hitting the very top of the excellent range, with its fire and scintillation just below. Such triple-excellent ratings establish that the diamond 60A deserves to reside in the same realm as traditional ideal cut round diamonds.

The diamond 60B (crown angle 22.94° and pavilion angle 41.38°) has a crown intensity of 80.6%. It also has excellent brightness, excellent fire, and excellent scintillation, thereby registering triple-excellent ratings. Accordingly, the diamond 60B also merits esteem equivalent to that given to traditional ideal cut round diamonds.

The diamond 60C (crown angle 23.63° and pavilion angle 42.14°) has a crown intensity of 82.0% and the diamond 60D (crown angle 22° and pavilion angle 42.76°) has a crown intensity of 80%. They both have excellent brightness, excellent scintillation, and very good fire. The less-than-excellent fire reading may make such diamonds slightly less worthy of the admiration pulled by the diamond 60A and/or the diamond 6B. But they still qualify as commendable competition for a traditional ideal cut diamond.

Closing

The circular cut diamond 10 has proportions adapted to achieve a brilliance which can compete with that of an ideal cut diamond. And, as is shown in FIGS. 6A, 6B, 6C through FIGS. 9A, 9B, 9C, the diamond 10 is compatible with a wider range of depth ratios, table sizes, girdle thicknesses, crown heights, and/or pavilion depths.

In the illustrated diamond 10, the crown 30 consisted of thirty-three facets, with the table 31 being counted a facet. When the pavilion 40 has a pointed tip 41, it consists of twenty-four facets. When the tip 41 is a culet, the pavilion consists of twenty-five facets, with the culet being counted as a facet. Thus, with a non-faceted girdle 2, the diamond 10 can consist of either fifty-seven facets (if the tip 41 is pointed) or fifty-eight facets (if the tip 41 is a culet). However, the diamond 10 could comprise more facets if, for example, the girdle 20 is faceted. And/or the diamond 10 could include one or more "extra" facets to accommodate imperfections.

The above discussion focused on diamonds, as it is common for them to fall culprit to the more-carats-is-always-better assumption. However, other gemstones could be substituted for diamonds to achieve similar brilliancy benefits. For example, precious gemstones (e.g., sapphires, emeralds, rubies, alexandrite, etc.), semi-precious gemstones (e.g., amethyst, garnet, morganite, etc.), and/or synthetic versions thereof are suitable candidates for the specified circular cut.

Although the gemstone 10, the girdle 20, the crown 30, the pavilion 40, and/or the jewelry 50, have been shown and described as having certain forms and fabrications, such portrayals are not quintessential and represent only some of the possible adaptations of the claimed characteristics. Other obvious, equivalent, and/or otherwise akin embodiments could instead be created using the same or analogous attributes.

The invention claimed is:

1. A circular cut diamond (10) comprising:

a girdle (20) with a circular upper edge (23) end a circular tower edge (24), a crown (30) comprising a table (31) forming its flat top surface, a circumferential succession of eight main crown facets (32), sixteen upper girdle facets (33), and eight table-starring facets (34), and a pavilion (40) comprising a tip (41) forming its bottommost aspect, a circumferential succession of eight main pavilion facets (42) and sixteen lower girdle facets (42);

wherein the eight main crown facets (32) extend upward from the girdle's upper edge (23) at a crown angle (A32) which is greater than 19° and less than 25°; and wherein the eight main pavilion facets (42) extend downward from the girdle's lower edge (24) at a pavilion angle (A42) greater than 41° and less than 43°; and wherein a diameter of the table ranges from 48% to 51.2% of a diameter of the girdle.

2. A circular cut diamond (10) as set forth in claim 1, wherein the pavilion angle (A42) is greater than 41.5°.

3. A circular cut diamond (10) as set forth in claim 1, having depth-ratio of 56% to 61%.

4. A circular cut diamond (10) as set forth in claim 1, having a crown height of 10% to 12%, and a pavilion depth of 40% to 45%.

5. A circular cut diamond (10) as set forth in claim 1, having a girdle thickness of greater than 3%.

6. A circular out diamond (10) as set forth in claim 1, wherein the crown (30) has only thirty-three facets, with the table (31) being counted as a facet.

7. A circular cut diamond (10) as set forth in claim 6, wherein the tip (41) is a point, and wherein the pavilion (40) has only twenty-four facets.

8. A circular cut diamond (10) as set forth in claim 6, wherein the tip (41) is a culet, and wherein the pavilion (40) has twenty-live facets, with the culet being counted as a facet.

9. A circular cut diamond (10) as set forth in claim 1, having depth ratio of 56% to 61%, a crown height of 10% to 12%, and a pavilion depth of 40% to 45%.

10. A circular cut diamond (10) as set forth in claim 9, wherein the crown angle (A32) ranges from greater than 19° and less than 22.9°.

11. A circular cut diamond (10) as set forth in claim 10, wherein the crown (30) has only thirty-three facets, with the table (31) being counted as a facet; wherein the tip (41) is a point; and wherein the pavilion (40) has only twenty-four facets.

12. A circular cut diamond (10) as sat forth In claim 10, wherein the crown (30) has only thirty-three facets, with the table (31) being counted as a facet; wherein the tip (41) is a culet; and wherein the pavilion (40) has only twenty-five facets, with culet being counted as a facet.

13. Jewelry (50) comprising the diamond (10) set forth in claim 1 mounted with mounting hardware (51).

14. Jewelry (50) as set forth in claim 13, wherein the mounting hardware (51) is for a ring, an earring, a necklace or a bracelet.

15. A circular cut gemstone (10) comprising:

a girdle (20) with a circular upper edge (23) and a circular lower edge (24), a crown (30) comprising a table (31) forming Its flat top surface, a circumferential succession of eight main crown facets (32), sixteen upper girdle facets (33), and eight table-starring facets (34), and a pavilion (40) comprising a tip (41) forming its bottommost aspect, a circumferential succession of eight main pavilion facets (42) and sixteen lower girdle facets (42);

wherein the eight main crown facets (32) extend upward from the girdle's upper edge (23) at a crown angle (A32) which is greater than 19° and less than 22.94°;

wherein the eight main pavilion facets (42) extend downward from the girdle's lower edge (24) at a pavilion angle (A42) which Is greater than 41° and less than 43°; and wherein a diameter of the table ranges from 48% to 52% of a diameter of the girdle.

16. A circular out diamond (10) as set forth in claim 1, wherein the pavilion angle (A42) is less than 41.38° and the crown angle (A32) is greater than 19° and less than 22.94°.

17. A circular cot diamond (10) as set forth in claim 1, wherein the girdle thickness ranges from 0.5% to 7.0%.

18. A circular out diamond (10) as set forth in claim 15, wherein the pavilion angle (A42) ranges from greater than 41° and up to about 41.38°.

19. A circular cut diamond (10) as set forth in claim 15, wherein the crown table size ranges from 48% to 51.3%.

20. A circular cut diamond (10) as set forth in claim 15, wherein the girdle ranges from 0.5% to 7.0%.

* * * * *